US008936522B2

(12) United States Patent
Weston

(10) Patent No.: US 8,936,522 B2
(45) Date of Patent: Jan. 20, 2015

(54) BATTING SWING TRAINING DEVICE

(71) Applicant: Jon M. Weston, West Des Moines, IA (US)

(72) Inventor: Jon M. Weston, West Des Moines, IA (US)

(73) Assignee: Swing Strong, LLC, Urbandale, IA (US)

( * ) Notice: Subject to any disclaimer, the term of this patent is extended or adjusted under 35 U.S.C. 154(b) by 143 days.

(21) Appl. No.: 13/623,490

(22) Filed: Sep. 20, 2012

(65) Prior Publication Data

US 2014/0080639 A1 Mar. 20, 2014

(51) Int. Cl.

| | |
|---|---|
| ***A63B 69/00*** | (2006.01) |
| *A63B 59/00* | (2006.01) |
| *A63B 49/00* | (2006.01) |

(52) U.S. Cl.

CPC ..... *A63B 69/00* (2013.01); *A63B 59/007* (2013.01); *A63B 69/0002* (2013.01); *A63B 49/00* (2013.01); *A63B 59/00* (2013.01); *A63B 2069/0008* (2013.01)

USPC ..... 473/437; 473/422; 473/457

(58) Field of Classification Search

CPC .... A63B 49/00; A63B 69/00; A63B 69/0002; A63B 59/0014; A63B 59/007; A63B 59/06

USPC ..... 473/422, 437, 457, 519, 564, 312, 231

See application file for complete search history.

(56) References Cited

U.S. PATENT DOCUMENTS

| | | | | |
|---|---|---|---|---|
| 1,138,196 | A * | 5/1915 | Diehl | 482/106 |
| 1,664,257 | A * | 3/1928 | McCullough | 473/203 |
| 2,031,161 | A * | 2/1936 | Hamel | 473/568 |
| 3,392,976 | A * | 7/1968 | Hayes | 473/564 |
| 3,498,616 | A * | 3/1970 | Hurst | 473/234 |
| 3,877,698 | A * | 4/1975 | Volpe | 473/520 |
| 4,682,773 | A | 7/1987 | Pomilia | |
| 4,819,935 | A | 4/1989 | Dirksing et al. | |
| 4,898,386 | A | 2/1990 | Anderson | |
| 5,215,307 | A * | 6/1993 | Huffman | 473/409 |
| 5,330,190 | A * | 7/1994 | Oakley, Jr. | 473/234 |
| 5,741,193 | A * | 4/1998 | Nolan | 473/457 |
| D395,477 | S * | 6/1998 | Vela | D21/756 |
| 6,010,415 | A | 1/2000 | Miggins | |
| 6,358,157 | B1 * | 3/2002 | Sorenson | 473/219 |
| 6,406,387 | B1 | 6/2002 | Ryan | |
| 6,561,930 | B2 | 5/2003 | Mabry | |
| 6,682,447 | B1 | 1/2004 | Black | |
| 7,682,267 | B2 * | 3/2010 | Libonati | 473/457 |
| 8,118,693 | B2 * | 2/2012 | Tande | 473/457 |
| 8,517,866 | B2 * | 8/2013 | Williams | 473/457 |
| 2002/0082126 | A1 | 6/2002 | Brundage | |

(Continued)

*Primary Examiner* — Mitra Aryanpour

(74) *Attorney, Agent, or Firm* — Brick Gentry PC; Brian J. Laurenzo; Jessica L. Susie

(57) ABSTRACT

A batting swing training device is provided to train a batter in bat and ball sports to properly swing a bat. The device includes three weighted portions, one near the knob of the bat, one near the distal end of the bat, and one near the center of the bat. The weights near the knob and center of the bat force the batter to lead the swing with the knob. The weight near the distal end of the bat trains the batter to properly snap the bat through or release the bat at the time of contact. Each weighted portion may include cavities to accept the weights. The handle may have an oval-shaped cross-section to reinforce the proper grip and knuckle alignment and a plurality of finger grooves, which also reinforce the proper grip and knuckle alignment.

11 Claims, 7 Drawing Sheets

(56) References Cited

U.S. PATENT DOCUMENTS

| | | | | |
|---|---|---|---|---|
| 2004/0162167 | A1* | 8/2004 | Stevens et al. | 473/457 |
| 2005/0261075 | A1* | 11/2005 | Pullaro | 473/256 |
| 2006/0025246 | A1* | 2/2006 | Forney et al. | 473/457 |
| 2007/0254751 | A1* | 11/2007 | Wilson | 473/457 |
| 2008/0113832 | A1* | 5/2008 | Ciesar et al. | 473/457 |
| 2010/0234144 | A1* | 9/2010 | Sutlovich et al. | 473/457 |
| 2011/0034275 | A1* | 2/2011 | Kim | 473/457 |
| 2011/0172035 | A1* | 7/2011 | Gregory | 473/457 |
| 2013/0196795 | A1* | 8/2013 | Shocklee | 473/457 |
| 2014/0080639 | A1* | 3/2014 | Weston | 473/457 |

* cited by examiner

BATTING SWING TRAINING DEVICE

FIELD OF THE INVENTION

This invention relates to a batting swing training device for bat and ball games, including, but not limited to, baseball and softball.

BACKGROUND

Some sports, including baseball and softball and variations thereof, require a person to swing a bat at a ball with the hope of scoring runs that will ultimately lead to victory. The parts of a baseball bat include the knob, which is the end of the bat closest to the handle, the taper between the knob and the handle, the handle, the throat which is located next to the handle and opposite the knob, a second taper region, which is located between the throat and the barrel of the bat, the barrel, and the tip, which is the end of the bat immediately adjacent to the barrel. The proper swing is handle first or more commonly and correctly, knob first. The batter's hands and elbows should stay close to the body and pull the handle or knob of the bat downward and forward toward the hitting zone, leaving the barrel behind and creating lag in the bat. As the elbow and hands near contact, the barrel catches up and surpasses the hands, snapping through to contact. Further, the batter should have the proper palm up hand position at contact, meaning that if the batter is swinging right-handed the right palm should be facing up at impact and the opposite if the batter is swinging left-handed.

Using the proper swing is important to success in the above-mentioned sports. Accordingly, devices exist to train batters to use the proper batting swing. For example, devices exist that include weights. However, the devices of the prior art, such as those described in United States Patent Application Publication No. 2002/0082126 and U.S. Pat. Nos. 6,561,930; 4,819,935; and 6,010,415 include weights near the barrel or striking region of the bat, which alone teaches an incorrect swing. Further U.S. Pat. No. 4,682,773 discloses a bat with an overall design that is heavier than a conventional bat, but it does not distribute the increased weight so as to reinforce the proper swing. U.S. Pat. No. 6,682,447 discloses a device with a single bore to receive weights, which may be distributed across the length of the bat using springs between the weights so as to replicate the weight of a conventional bat. U.S. Pat. No. 4,898,386 includes one weight located inside the handle of the bat for increasing the batter's strength. U.S. Pat. No. 6,406,387 discloses a bat with two handle portions, one movable and one non-movable, that both include finger grooves to help align the batter's hands.

Many of the weighted devices described above, as well as the commonly used batting doughnuts, include a weight placed near the barrel end of the bat. This weight arrangement creates an improper swing technique by forcing the barrel end of the bat away from the batter's body too early in the swing and creates a long, casting motion, causing the batter to drag the bat to contact, instead of employing the proper, short, compact, inside out swing. Some of the devices of the prior art are training bats which are heavier than conventional bats, but that distribute the weight evenly on the device and, therefore, only increase the batter's strength and do not teach the proper swing. Accordingly, there is a need in the art for a device that teaches the proper, short, compact, inside out swing. There are also devices in the prior art which include finger grooves to help align the batter's hands and teach the proper grip and leading arm motion. However, these devices do not work in conjunction with weights to train the proper swing path.

Accordingly, there is a need in the art for a device that teaches the proper grip while also reinforcing the proper swing.

SUMMARY

The batting swing training device of the present invention is a triple weighted training bat. The device includes two weights above and below the batter's hand location on the handle of the bat, with one or more weights at the knob just below the batter's hands and one or more weights at the top of the handle just above the batter's hands. A third weight is located at the distal or barrel end of the bat. The weights positioned around the batter's hands force the batter to keep the handle of the bat close to the batter's body to create a compact or inside approach to the ball and to pull the handle ahead of the barrel. This enforces the proper feel of pulling the handle or the knob of the bat first, leading to and allowing the barrel to snap through to contact. The weight at the barrel end of the bat reinforces the proper snap through or release of the barrel of the bat.

The preferred embodiment of the batting swing training device further includes an oval handle. The oval handle properly aligns the knuckles of the batter's hands while keeping the handle positioned in the batter's fingertips. Moreover, the oval shape of the handle also creates proper hand and bat alignment throughout the entire swing plane, thereby enforcing the correct, palm up hand position at contact.

The invention as set forth in one or more of the claims provides one or more of the following objectives:

It is an objective of the present invention to enforce proper hand and grip alignment in the batting swing.

It is another objective of the present invention to enforce creation of a compact batting swing as well as a powerful snap extension.

It is a further objective of the present invention to teach the correct swing path.

It is yet another objective of the present invention to develop proper muscle memory for the proper batting swing.

It is still another objective of the present invention to create a more efficient and powerful swing.

It is also an objective of the present invention to provide a device that can be used as a training aid and as a warm-up bat.

Other objectives and features of the present invention will be apparent from the drawings and detailed description set forth herein.

DETAILED DESCRIPTION

The following is a detailed description of embodiments of the batting swing training device 100 of the present invention. For ease of discussion and understanding, the following detailed description and illustrations refer to the batting swing training device 100 for use with baseball. It should be appreciated that the batting swing training device 100 may be used as a swing training aid in any sport requiring a player to swing a bat. For example, the batting swing training device 100 may be used by softball players.

Figure 1:
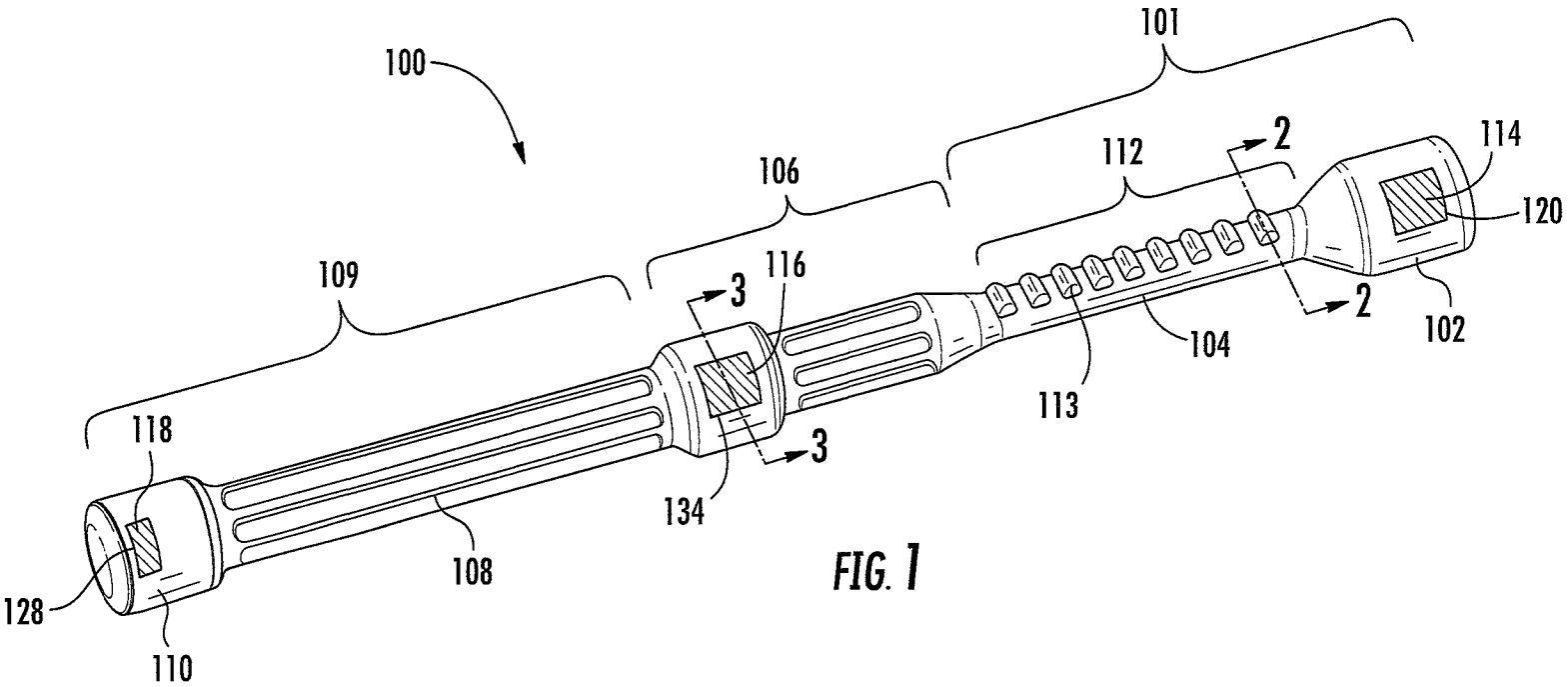
FIG. 1 is a perspective view according to one embodiment of a batting swing training device of the present invention.
Figure 2:
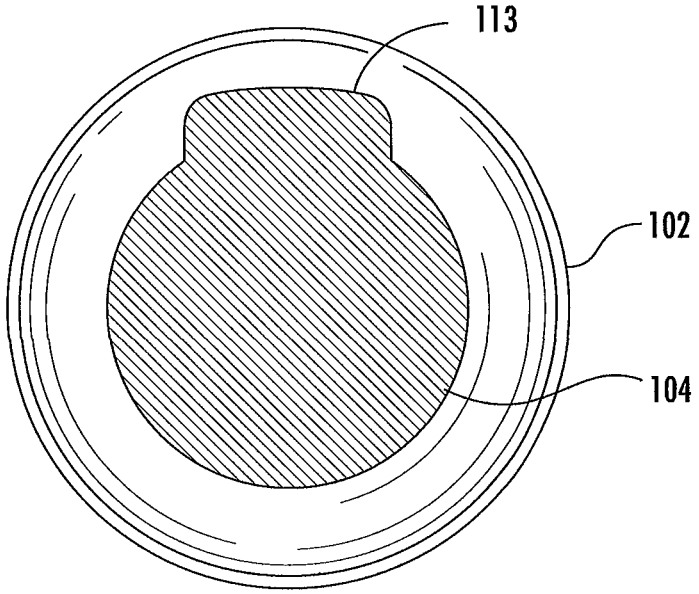
FIG. 2 is a cross-sectional view of the batting swing training device of FIG. 1 taken along the lines 2-2.

Referring to FIG. 1, in the preferred embodiment of the batting swing training device 100, the device 100 is split into three sections: a handle section 101, an intermediate section 106, and a distal section 109. Generally, the batting swing training device 100 is made of injection molded plastic. However, any suitable material and manufacturing method may be used. The handle section 101 includes a knob or knob member 102 and a handle 104. In the preferred embodiment, the handle 104 includes a portion with a generally oval-shaped cross section, as shown in FIG. 2, which is a cross section of the handle 104 of the device 100. Further, in the preferred embodiment, the handle includes a plurality of finger grooves 112 with raised portions 113 located at one end of the major axis of the oval, also shown in FIGS. 1 and 2. However, one of skill in the art will recognize that the batting swing training device 100 need not include finger grooves. Furthermore, the batting swing training device 100, including the handle 104, may be any shaped cross section without departing from the scope of the invention. The preferred oval-shaped cross section aligns the batter's knuckles and, therefore, enforces the proper grip. The plurality of finger grooves 112 further enforces the proper grip, as will be discussed in further detail below. The distal section includes a barrel 108 and a distal end piece 110.

For purposes of discussion and illustration the bottom of the batting swing training device 100 will be the knob 102, and the top of the batting swing training device 100 will be the distal end piece 110. Further, the proximate section of the batting swing training device 100 will be the handle section 101, including the knob 102 and handle 104, and the distal section 109 will be the barrel 108 and distal end piece 110. The intermediate section 106 is located between the proximate section and distal section 109. The batting swing training device 100 of the present invention is generally elongated, similar to a conventional bat, but it is shaped somewhat differently than a conventional bat, with the cross sections of the knob 102, a portion of the intermediate section 106, and the distal end piece 110 having a greater area than the cross sections of the handle 104 and barrel 108. However, one skilled in the art will recognize that the batting swing training device 100 could be many shapes, including the shape of a conventional bat without departing from the scope of the present invention.

The batting swing training device 100 generally includes three weighted sections along the elongated structure. First, there is a weighted section at or near the bottom of the batting swing training device 100 in the handle section 101. The second weighted section is generally located above the batter's hands in the center or throat or intermediate section 106 of the batting swing training device 100. Finally, the third weighted section is located in the distal section 109 of the batting swing training device 100, preferably at or near the top of the batting swing training device 100, in the distal end piece 110 or barrel 108. Accordingly, in its simplest form, the batting swing training device 100 of the present invention is an elongated device including three weights: one in the handle section 101, one in the intermediate section 106, and one in the distal section 109.

Figure 3:
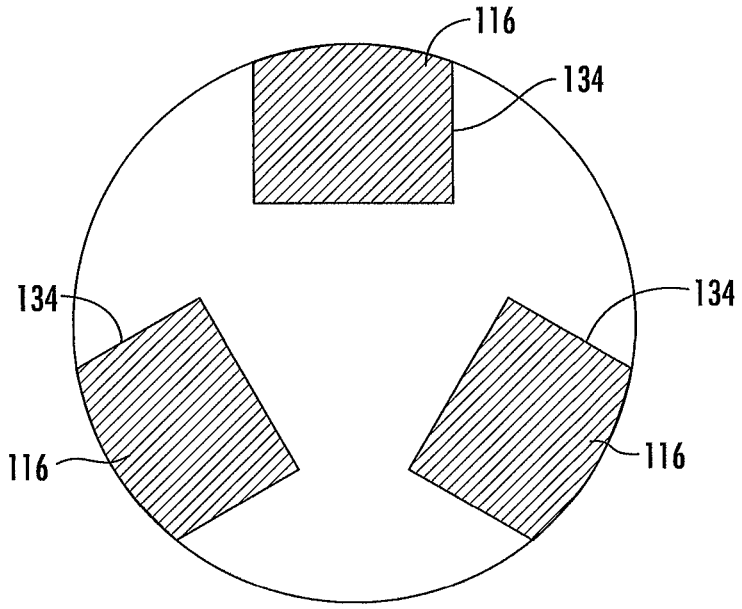
FIG. 3 is a cross-sectional view of the batting swing training device of FIG. 1 taken along the lines 3-3.

The weighted sections may include one or more weights. Further, the one or more weights may be either fixed or selectively removable and adjustable; however, it is advantageous for the batting swing training device 100 to include no moving parts. As can be seen in FIGS. 1 and 3, the three weighted sections each include three weights. Although FIG. 3 is a cross-section of the intermediate section 106, it is representative of the cross-sections of all three weighted sections. Accordingly, in the preferred embodiment, during the manufacturing process, nine weights are inserted into the injection molded plastic, three at the knob 102, three at the intermediate section 106, and three at the distal end piece 110. The nine weights are fixed in the bat and are not removable. One of skill in the art will recognize that the weights may be any weight, which will be discussed in further detail below.

The weighted section located below the batter's hands is generally in the handle section 101, such as in the handle 104 or, as in the preferred embodiment, in the knob member or knob 102. Further, in the preferred embodiment, the first weighted section includes at least one handle section cavity, which in the preferred embodiment is at least one knob member cavity 120. As one skilled in the art will recognize, the handle section may include any number of cavities located around or below the batter's hands to receive weights. In the preferred embodiment, three knob cavities 120 are present to receive three handle section weights or knob member weights or knob weights 114. One knob member cavity 120 and knob weight 114 can be seen in FIG. 1. The other two knob cavities 120 and knob weights 114 are equally spaced around the circumference of the knob, in the same configuration as the cross section of the intermediate section 106 shown in FIG. 3. In the preferred embodiment, the knob weights 114 are generally cuboid-shaped with one rounded surface that is flush with the rounded surface of the knob 102.

The weighted section located at the top of the batting swing training device 100 is generally in the distal section 109, such as in the barrel 108 or, as in the preferred embodiment, in the distal end piece 110. Further, in the preferred embodiment, this weighted section includes at least one distal section cavity, which in the preferred embodiment is at least one distal end piece cavity 128. As one skilled in the art will recognize, the distal section may include any number of cavities located at the top of the bat to receive weights. In the preferred embodiment, three distal end piece cavities 128 are present to receive three distal section weights or distal end piece weights 118. One distal end piece cavity 128 and distal end piece weight 118 can be seen in FIG. 1. The other two are equally spaced around the circumference of the distal end piece 110, in the same configuration as the cross section of the intermediate section 106 shown in FIG. 3. It is noted that the distal end piece weights 118 are smaller than the knob weights 114 and intermediate section weights 116, which will be described in further detail below. In the preferred embodiment, the distal end piece weights 118 are generally cuboid-shaped with one rounded surface that is flush with the rounded surface of the distal end piece 110.

The third weighted section is located above the batter's hands and is generally located in the center or throat or intermediate section 106 of the batting swing training device 100. The intermediate section 106 is located between the handle section 101 and distal section 109 and, accordingly, is located between the handle 104 and barrel 108 of the batting swing training device 100. However, one skilled in the art will recognize that this weighted section may be located anywhere at, near, or above the batter's hands. In the preferred embodiment, the intermediate section 106 includes at least one center cavity or intermediate section cavity 134 to receive at least one center weight or intermediate section weight 116. As one skilled in the art will recognize, the intermediate section 106 may include any number of cavities to receive intermediate section weights 116. In the preferred embodiment, three intermediate cavities 134 are present to receive three center weights or intermediate section weights 116.

FIGS. 1 and 3 illustrate the intermediate section cavities 134 and intermediate section weights 116 in more detail. One intermediate section weight 116 and intermediate section cavity 134 can be seen in FIG. 1. The other two intermediate section weights 116 and intermediate section cavities 134 are located at equal distances around the circumference of the intermediate section 106, which can be seen in FIG. 3. FIG. 3 is a cross sectional view of the intermediate section 106 of the batting swing training device; however, it is also representative of the cross-sections of the knob 102 and distal end piece 110. As can be seen, the weights are generally cuboid-shaped with one rounded surface that is flush with the rounded surface of the intermediate section 106.

Although the total weight of the batting swing training device 100 may be any weight, total weights of four, six, and seven pounds are desirable. It is anticipated that the four pound device 100 will be used by males under the age of thirteen and females under the age of eighteen. The six pound device 100 will generally be used by males from thirteen to eighteen years of age and possibly females over fifteen years of age. The seven pound device 100 will generally be used by males of high school age or older, including males in college or playing professional baseball. Further it is desirable for the distal end piece weights 118 to be lighter than the intermediate section weights 116 and knob weights 114. As can be seen in FIG. 1, the distal end piece weights 118 are smaller than the intermediate section weights 116 and knob weights 114.

The above-described weight arrangement encourages the proper compact or inside approach to the batting swing. The heavier weights positioned around the batter's hands force the batter to keep the handle 104 of the device 100 close to the batter's body, thereby creating a compact or inside approach to the ball. Further, the heavier knob weights 114 and intermediate section weights 116 cause the batter to pull the knob 102 and handle 104 of the device 100 first, allowing the barrel 108 and distal end piece 110 to lag behind. The lighter distal end piece weights 118 further reinforce the proper snap through or release of the barrel 108 of the device. Accordingly, the combination of the three weighted sections of the batting swing training device 100 enforces the creation of a compact batting swing as well as a powerful snap extension and further teaches the correct swing path. The swing taught by the batting swing training device 100 is efficient and powerful. The batting swing training device 100 further teaches the proper swing speed.

Figure 4:
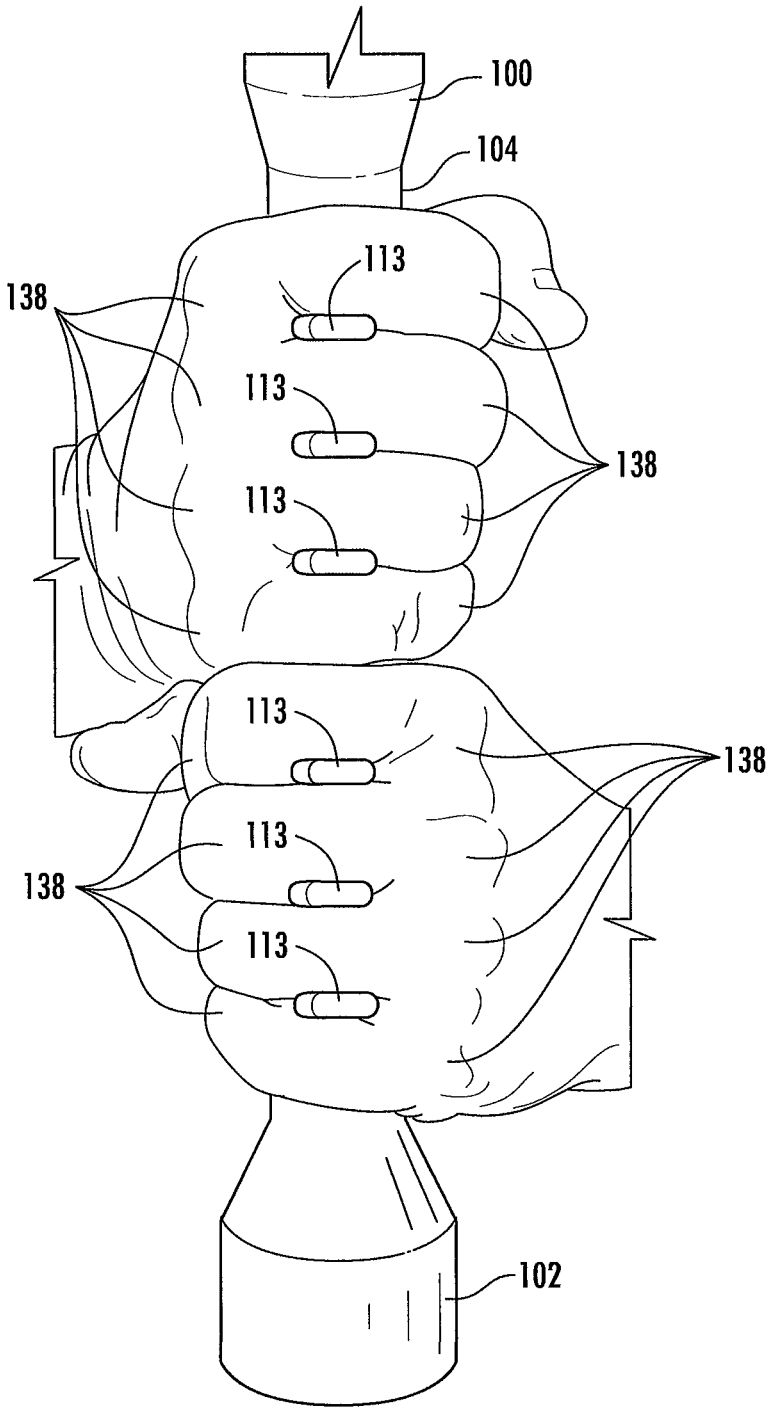
FIG. 4 is a perspective view of a batter gripping the batting swing training device of FIG. 1 with the proper knuckle alignment as taught by the batting swing training device of the present invention.

As discussed above, the device 100 includes a handle section 101 that includes a handle 104 with an oval-shaped cross-section. The oval-shaped cross-section teaches the proper batting grip. Specifically, the oval shape forces the batter to properly align his knuckles. As shown in FIG. 4, the batter's knuckles 138 should align when the batter properly grips the handle 104. Further reinforcing this grip is the plurality of finger grooves 112. The raised portions 113 of the finger grooves 112 fall between the batter's fingers, thus enforcing the proper hand and grip alignment in the batting swing. Specifically, the back of the batter's finger knuckles should rest in the grooves.

Figure 5:
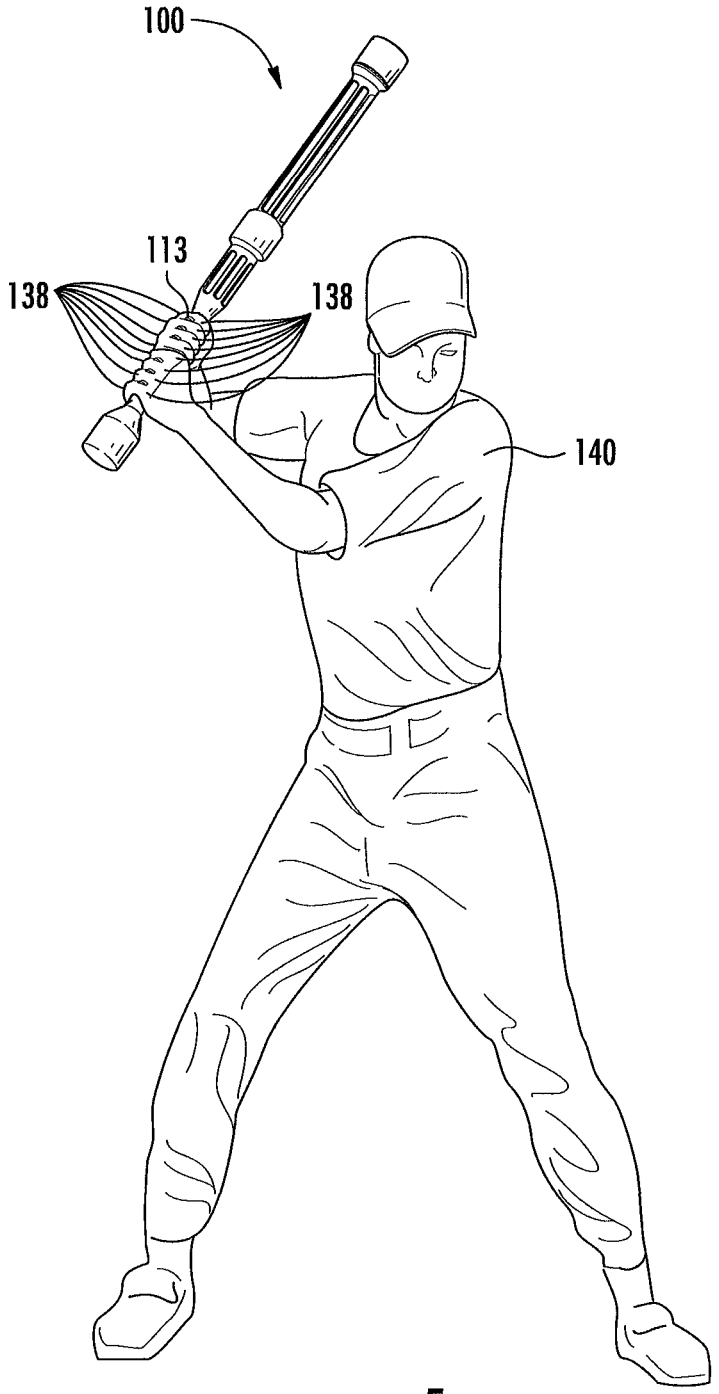
FIG. 5 is a perspective view of a batter waiting to swing the batting swing training device of FIG. 1 using the proper grip as taught by the batting swing training device of the present invention.
Figure 6:
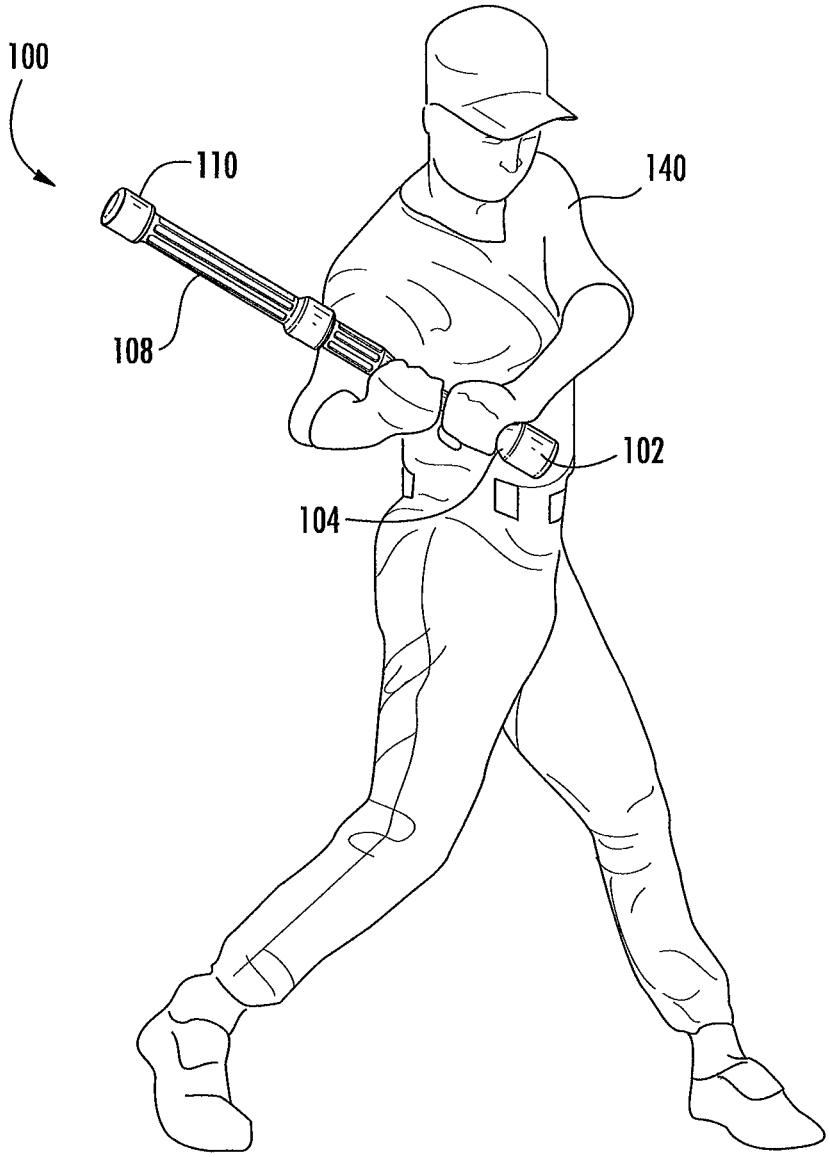
FIG. 6 is a perspective view of the batter of FIG. 5 beginning to swing the batting swing training device of FIG. 1, leading with the knob of the device as the barrel lags behind and with his hands and elbows close to his body, as taught by the batting swing training device of the present invention.
Figure 7:
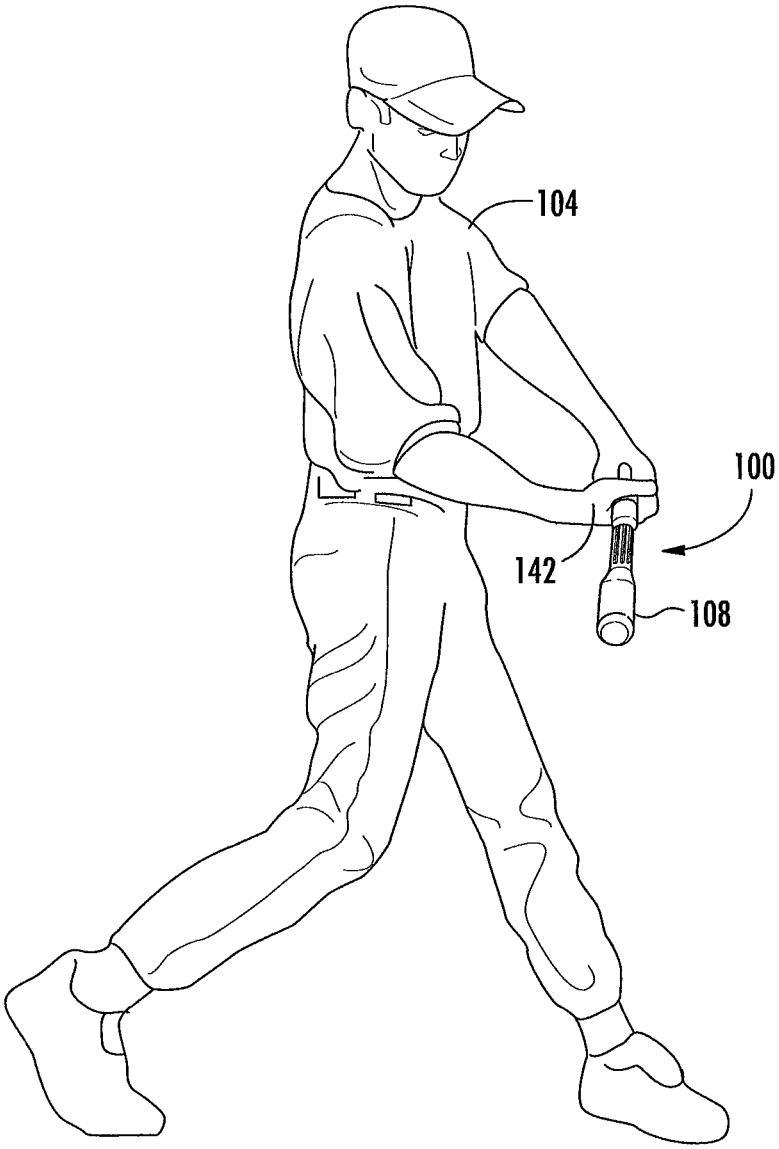
FIG. 7 is a perspective view of the batter of FIGS. 5-6 swinging the batting swing training device of FIG. 1 with the proper palm up position at the point when the bat would make contact with the ball as taught by the batting swing training device of the present invention.

FIGS. 5-7 illustrate a batter 140 using the batting swing training device 100 to learn and reinforce the proper swing and grip. The illustrations refer to a right-handed batter. However, the batting swing training device 100 can similarly be used by a left-handed batter. FIG. 5 shows the batter as he is waiting to swing the batting swing training device 100. The batter is gripping the batting swing training device 100 with the appropriate grip, as taught by the batting swing training device 100. Specifically, as discussed above, the second knuckles 138 of the batter are aligned on the handle 104 of the batting swing training device 100. The raised portions 113 of the plurality of finger grooves 112 are located between the batter's 140 fingers to reinforce the proper grip.

In FIG. 6, the batter 140 has begun his swing. As is illustrated, the knob 102 and handle 104 are leading the device 100 through the swing, with the barrel 108 lagging behind. This motion is reinforced by the knob weights 114 and intermediate section weights 116. Because in the preferred embodiment the distal end piece weights 118 are lighter than the knob weights 114 and intermediate section weights 116, the barrel 108 and distal end piece 110 of the bat are lagging behind as the batter 140 pulls the device 100 downward into the swing. The batter's 140 hands and elbow are close to his body, as the proper swing requires.

In FIG. 7, the batter 140 is at the point in his swing where he would make contact with a ball. The distal end piece weights 118 have caused the barrel 108 to snap through or release to the proper position for hitting the ball. Further, as reinforced by the oval-shaped cross-section of the handle 104 and the plurality of finger grooves 112, the batter's 140 right hand 142 is in the palm up position, as is proper at this point in the swing. If the batter 140 was left-landed, his left hand would be in the palm up position at this point in the swing. The batter 140 may use the batting swing training device 100 as a training aid or as a warm-up bat in a game. The batting swing training device 100 develops the muscle memory in the batter 140 that is necessary to consistently use the proper swing.

Figure 8:
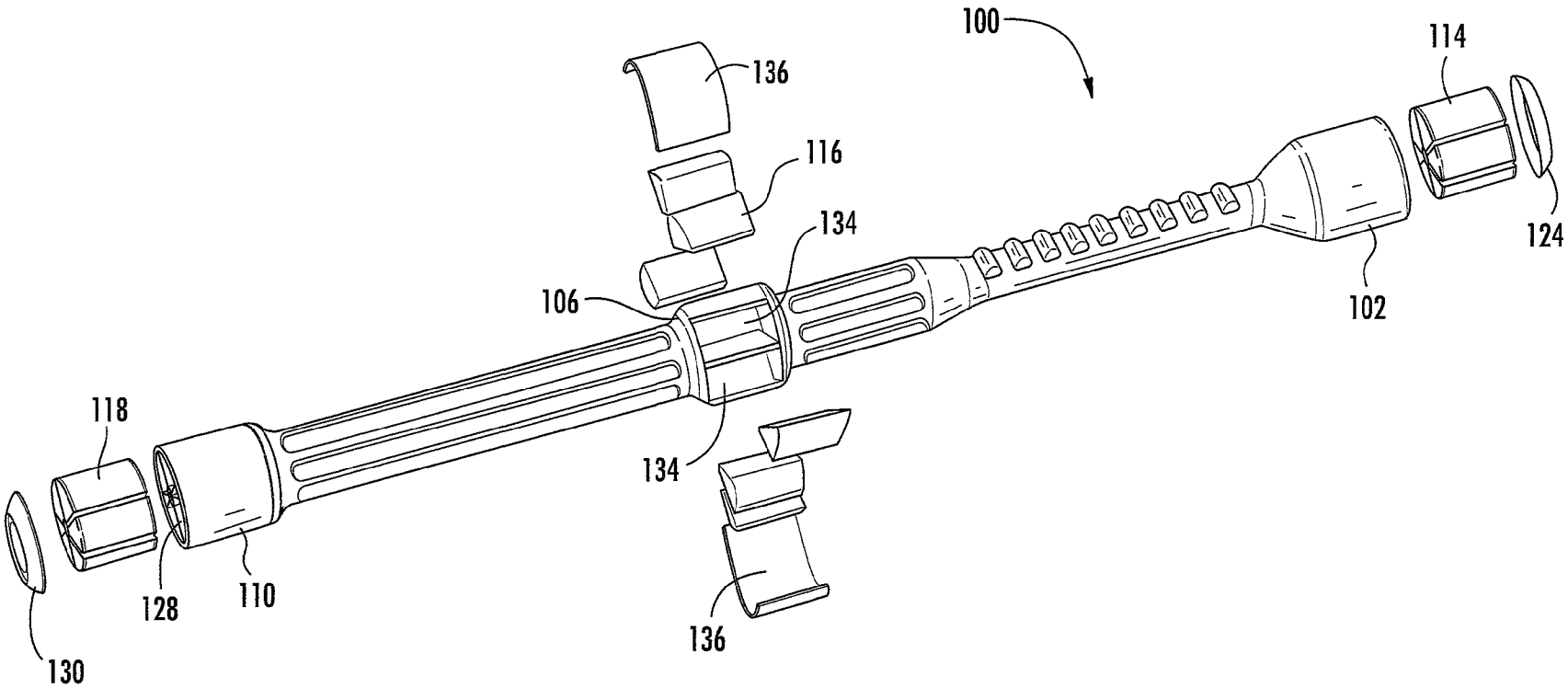
FIG. 8 is an exploded view of an alternative embodiment of a batting swing training device of the present invention.

An alternative embodiment of the batting swing training device 100 can be seen in FIG. 8. In the alternative embodiment, the distal end piece 110 includes six distal end piece cavities 128, the intermediate section 106 includes six intermediate section cavities 134, and the knob 102 includes six knob cavities (not shown) that each receives one or more weights. The alternative embodiment of the batting swing training device 100 includes a knob cap 124, distal end piece cap 130 and two intermediate section caps 136 to hold the knob weights 114, distal end piece weights 118, and intermediate section weights 116, in place, respectively. Optionally, the knob cap 124, distal end piece cap 130, and two intermediate section caps 136 may be selectively removable, allowing the user to access the cavities and change the weights as necessary.

Although various representative embodiments of this invention have been described above with a certain degree of particularity, those skilled in the art could make numerous alterations to the disclosed embodiments without departing from the spirit or scope of the inventive subject matter set forth in the specification and claims. Joinder references (e.g. attached, adhered) are to be construed broadly and may include intermediate members between a connection of elements and relative movement between elements. As such, joinder references do not necessarily infer that two elements are directly connected and in fixed relation to each other. In some instances, in methodologies directly or indirectly set forth herein, various steps and operations are described in one possible order of operation, but those skilled in the art will recognize that steps and operations may be rearranged, replaced, or eliminated without necessarily departing from the spirit and scope of the present invention. It is intended that all matter contained in the above description or shown in the accompanying drawings shall be interpreted as illustrative only and not limiting. Changes in detail or structure may be made without departing from the spirit of the invention as defined in the appended claims.

Although the present invention has been described with reference to the embodiments outlined above, various alternatives, modifications, variations, improvements and/or substantial equivalents, whether known or that are or may be presently foreseen, may become apparent to those having at least ordinary skill in the art. Accordingly, the embodiments of the invention set forth above are intended to be illustrative, not limiting. Persons skilled in the art will recognize that changes may be made in form and detail without departing from the spirit and scope of the invention. Therefore, the invention is intended to embrace all known or earlier developed alternatives, modifications, variations, improvements, and/or substantial equivalents.

The invention claimed is:

1. An elongated batting swing training device comprising:
- a handle section comprising at least one weight;
- a throat adjacent to said handle section comprising at least one center cavity for receiving at least one center weight;
- a barrel adjacent to said throat located on the opposite end of said throat from said handle; and
- a distal section located adjacent to said barrel on the opposite side of said barrel from said throat comprising at least one weight.

2. The elongated batting swing training device of claim 1 wherein said handle section comprises:
- a knob member; and
- a portion comprising a generally oval cross section and a plurality of finger grooves.

3. The elongated batting swing training device of claim 1 wherein said handle section comprises at least one handle section cavity for receiving at least one handle section weight.

4. The elongated batting swing training device of claim 3 wherein said handle section comprises a segmented cavity for receiving at least three handle section weights.

5. The elongated batting swing training device of claim 2 wherein said knob member comprises at least one know member cavity for receiving at least one knob member weight.

6. The elongated batting swing training device of claim 1 wherein said distal section includes at least one distal section cavity for receiving at least one distal section weight.

7. The elongated batting swing training device of claim 6 wherein said distal section includes a segmented cavity for receiving at least three distal section weights.

8. The elongated batting swing training device of claim 1 wherein said throat includes a segment cavity for receiving at least three weights.

9. The elongated batting swing training device of claim 1 wherein the total weight of the device is selected from the group consisting of four pounds, six pounds, and seven pounds.

10. An elongated batting swing training device comprising:
- a knob member comprising at least one knob member cavity for receiving at least one knob member weight;
- a handle adjacent to said knob member;
- a portion of said handle having a generally oval cross section;
- a plurality of finger grooves located on said portion of said handle having a generally oval cross section;
- a throat adjacent to said handle located on the opposite end of said handle from said knob member, said throat comprising at least one center cavity for receiving at least one center weight;
- a barrel adjacent to said throat located on the opposite end of said throat from said handle; and
- a distal end piece adjacent to said barrel located on the opposite end of said barrel from said throat and opposite said knob member, said distal end piece comprising at least one distal end piece cavity for receiving at least one distal end piece weight.

11. The elongated batting swing training device of claim 10, wherein said knob member, said throat, and said distal end piece each have a greater cross sectional area than said handle and said barrel.

* * * * *